United States Patent [19]

Posciri

[11] 4,304,440

[45] Dec. 8, 1981

[54] ROLLER CUTTER

[76] Inventor: Charles L. Posciri, S.R. D - Box 9360, Palmer, Ak. 99645

[21] Appl. No.: 97,490

[22] Filed: Nov. 26, 1979

Related U.S. Application Data

[63] Continuation-in-part of Ser. No. 1,388, Jan. 5, 1979.

[51] Int. Cl.[3] ..... E21C 27/10

[52] U.S. Cl. ..... 299/86; 299/25; 175/377

[58] Field of Search ..... 299/86, 87, 24, 25, 299/40; 175/377, 378, 374

[56] References Cited

U.S. PATENT DOCUMENTS

| | | | |
|---|---|---|---|
| 1,856,627 | 5/1932 | Fletcher | 175/378 X |
| 2,244,617 | 6/1941 | Hannum | 175/377 X |
| 3,393,014 | 7/1968 | Ascher, Jr. | 299/40 |
| 3,726,350 | 4/1973 | Pessier | 175/374 |
| 3,860,292 | 1/1975 | Bechem | 299/86 |
| 3,967,854 | 7/1976 | Posciri | 299/25 X |

*Primary Examiner*—William F. Pate, III

*Attorney, Agent, or Firm*—Graybeal & Uhlir

[57] ABSTRACT

A roller cutter especially adapted to fracture permafrost material includes a plurality of cutter teeth integrally formed with, and extending radially outwardly from the outer surface of a rotor. The rotor is antifrictionally supported on a stator to enable it to rotate about it along its longitudinal axis. The cutter teeth are arranged about the circumference of the rotor in a plurality of rings, with the rings uniformly spaced along the length of the rotor. The rings of teeth are progressively rotated relative to each other so that corresponding teeth of adjacent rows are staggered with respect to each other. However, the teeth of the rows at each end of the rotor are aligned along the rotor length.

10 Claims, 10 Drawing Figures

ROLLER CUTTER

CROSS REFERENCE TO RELATED APPLICATION

The present application is a continuation-in-part of my copending and now abandoned application Ser. No. 1,388, filed Jan. 5, 1979.

FIELD OF THE INVENTION

The present invention relates to excavating and earth moving equipment. More specifically, it relates to improved roller cutters for penetrating, fracturing and loosening hard ground material.

DESCRIPTION OF THE PRIOR ART

Various types of roller cutters have been used on different forms of earth moving equipment. A cylindrical type of roller cutter for use on an endless bucket type excavator is disclosed by my own U.S. Pat. No. 3,967,854, granted July 6, 1976. The excavator is constructed of a plurality of forwardly open buckets which are mounted on the periphery of a large diameter wheel that is supported for rotation about its transverse axis and for translation along the ground. Roller cutters of my '854 patent each include a cylindrical drum which is mounted transversely on the leading edge of each bucket for rotation about the longitudinal axis of the drum when the excavator wheel is in motion. A plurality of cutter teeth extend radially outwardly from the surface of the drum. The teeth are aligned in straight rows, which rows extend longitudinally along the outer surface of the drum and are spaced about the circumference of the drum. In use, as the drum rotates about its longitudinal axis, all of the teeth of a particular row simultaneously enter the ground and then exit the ground.

A conical type of roller cutter, adapted for use on an earth boring drill, is disclosed by U.S. Pat. No. 3,726,350, granted Apr. 10, 1973, to Rudolf Pessier wherein a plurality of roller cutters are transversely mounted on the front or leading face of a drill bit. The roller cutters themselves are characterized by a conical shaped drum which is supported for rotation about its longitudinal axis and by a plurality of cutter teeth which extend radially outwardly from the surface of the cone-shaped drum. In operation, the drill bit rotates about its longitudinal axis, which is also the longitudinal axis of the bore being drilled, and simultaneously advances forwardly, thereby causing the roller cutters to rotate about their respective longitudinal axes to cut away at the ground material located immediately in front of the drill bit. The cutter teeth in the Pessier patent are nonuniformly arranged about the outer surface of the conical drum to prevent the teeth from tracking one another and to prevent premature wear of the drum itself. Simply staggering the location of teeth, however, does not ensure that only a minimum number of teeth at a time are loaded by the drum to thereby minimize a force needed to break up the ground. Moreover, although the teeth are usually made from very hard materials, such as from tungsten carbide, the brittleness of such materials limits the height that the teeth can extend above the drum.

Disk types of roller cutters for use on an earth boring machine is disclosed in U.S. Pat. No. 3,430,718, granted Mar. 4, 1969, to James C. Lawrence and for use on a ripping implement mounted on a bulldozer is disclosed in U.S. Pat. No. 3,393,014, granted July 16, 1968, to Leonhard Ascher, Jr. These types of roller cutters include a rotating disk which is supported to rotate about an axis perpendicular to the plane of the disk. A plurality of teeth are located around the circumferential rim of the disk to form the cutting edge of the cutter. As illustrated and described in the Lawrence patent, the disk can be canted in respect to its axis of rotation so that the cutter teeth do not track one another and so that the disk sweeps a kerf which is larger than the thickness of the disk itself.

Also of interest in the field of roller cutters having staggered cutting teeth is U.S. Pat. No. 3,398,989, granted Aug. 27, 1968, to Frank I. Christensen. This patent and those described above together with the prior art that was cited and considered by the Patent Office before granting them, and which is listed on the patents, should be consulted for the purpose of properly evaluating the suject invention and putting it into proper perspective.

SUMMARY OF THE INVENTION

Figure 1:
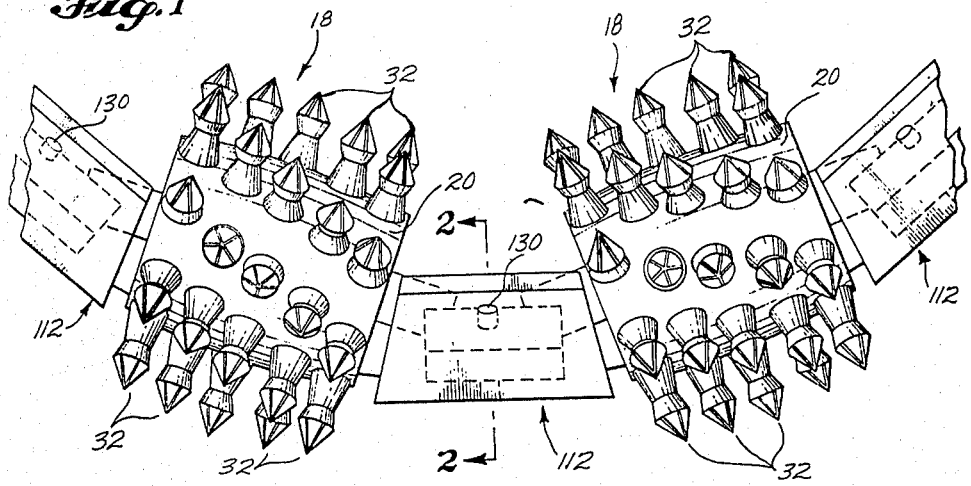
FIG. 1 is a fragmentary front elevational view illustrating typical roller cutters of the present invention mounted on the lip of a bucket of an endless bucket type excavator and separated by a scoop tooth.

The present invention relates to a novel roller cutter mountable on earth moving equipment to penetrate hard ground material for fracturing and loosening such ground material. Such roller cutter is especially adapted for use in excavating frozen ground such as perma-frost found in cold climates. However, the roller cutter of the present invention is not limited to this use, but also can be utilized for fracturing and loosening other types of hard ground material which often cannot be satisfactorily penetrated by known cutters.

The present invention in basic form comprises an annular rotor which is anti-frictionally supported on a stator to enable the rotor to rotate about its longitudinal axis. A plurality of cutter teeth, which are integrally formed with the rotor, extend radially outwardly from the outer surface of the rotor. In profile, each tooth is of a height substantially greater than its width. Furthermore, the cutter teeth are arranged about the circumference of the rotor in a plurality of rings such that the teeth of each of the rings are progressively staggered with respect to the teeth of the adjacent rings. Thus, as the earth moving equipment travels forwardly, the rotor rotates about its longitudinal axis thereby progressively penetrating the teeth into the ground material and removing the teeth from the ground material such that only a minimum number of teeth at a time are in line with the reactive force imparted on the stator as the roller cutter is drawn through the ground.

Moreover, each cutter tooth preferably includes a plurality of cutter blades, which blades are integrally formed with the tooth and extend outwardly from the outer surface of the tooth. The cutter blades are constructed from material which is substantially harder than the tooth itself.

It is a primary object of the present invention to provide a roller cutter with a plurality of cutting teeth which are arranged such that at any given time only a minimum number of teeth are aligned with the force imparted on the rotor by the stator and thus the reaction force imparted on the cutter by the ground material to thereby minimize the driving force needed to power the roller cutter.

Another object of the present invention is to provide a roller cutter which has teeth that include cutting blades made from material substantially harder than the bodies of the teeth themselves to thereby prolong the useful life of the teeth.

Still a further object of the present invention is to provide a roller cutter having teeth integrally formed with a rotor and having cutter blades integrally formed with the teeth.

Still another object of the present invention is to provide a roller cutter which can be used on a variety of different implements and earth moving machines.

One more object of the present invention is to provide a roller cutter which can be easily and quickly mounted on and dismounted from numerous implements and earth moving machines.

Another object of the present invention is to provide a roller cutter which is not only economical to manufacture and replace, but which is also durable and capable of efficiently fracturing and loosening hard ground material.

Still another object of the present invention is to provide a scoop tooth cutter which has an easily replaceable, ground-engaging bit.

DESCRIPTION OF THE PREFERRED EMBODIMENT

Figure 5:
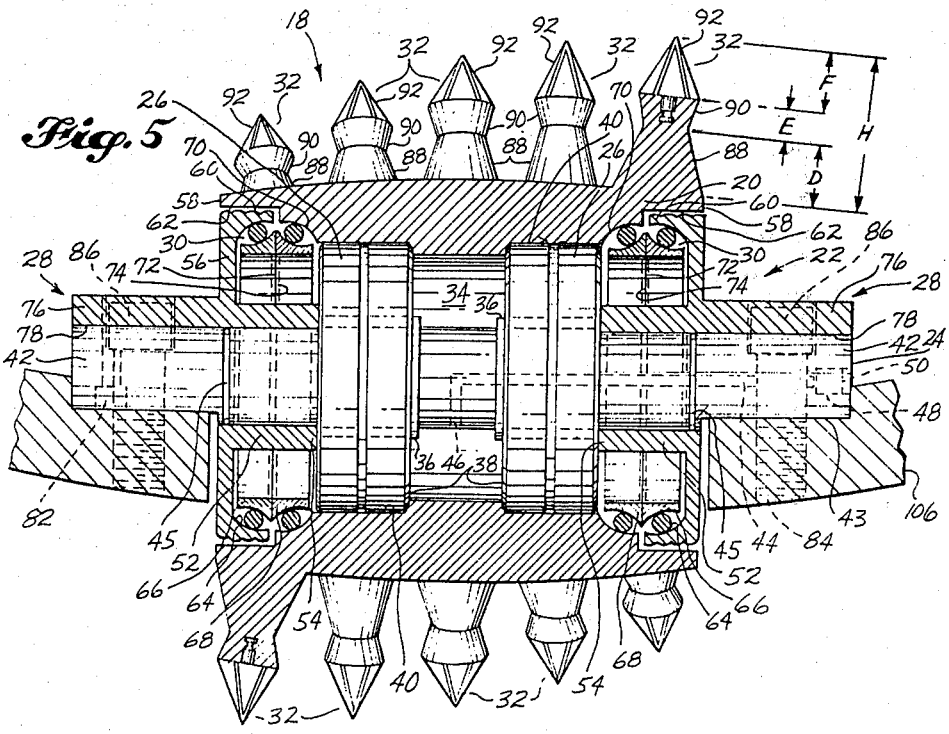
FIG. 5 is an enlarged cross-sectional view of the roller cutter shown in FIG. 4 taken substantially along lines 5—5 thereof.

Referring initially to FIG. 5, shown in cross-sectional view is a typical roller cutter 18 constructed according to the present invention. In the preferred form illustrated, it comprises an annularly shaped rotor 20 which is supported for rotation about its longitudinal axis by stator 22. Said stator 22 includes an elongate shaft or axle 24 which carries a pair of longitudinally spaced apart bearings 26, which bearings in turn anti-frictionally support rotor 20. Stator 22 also includes a pair of end caps 28 that serve to mount the roller cutter of the present invention on various implements and earth moving machinery. A pair of cone type face seals 30 are provided to prevent the material being excavated from reaching and thus contaminating the bearings 26. A plurality of cutter teeth 32, integrally formed with rotor 20, extend radially outwardly from and are selectively arranged about the outer surface of rotor 20.

Figure 6:
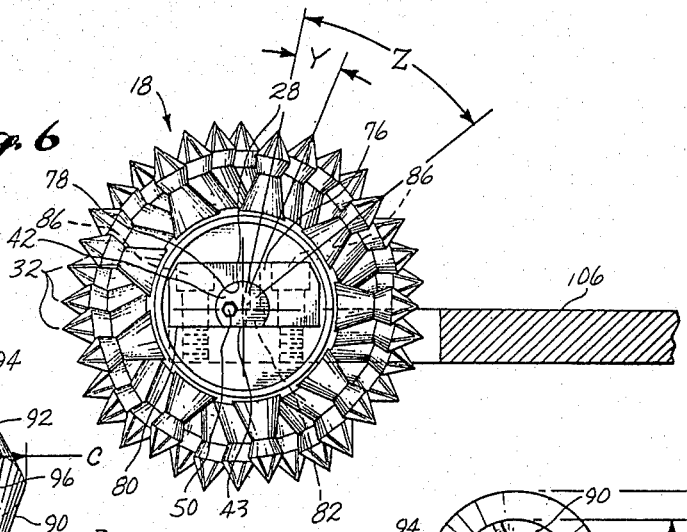
FIG. 6 is an end elevational view of a typical roller cutter constructed according to the instant invention.

As most clearly shown in FIGS. 5 and 6, rotor 20 is of an elongate, annular shape somewhat resembling the shape of a cylinder or barrel having a longitudinal interior cavity 34. Portions of stator 22 extend through cavity 34 to support rotor 20 for anti-frictional rotation about its longitudinal axis as roller cutter 18 is drawn through the ground by earth moving equipment. Stator 22 includes an elongate, generally circular shaft or axle 24 which is disposed along the axis of rotation of rotor 20 by a pair of space apart roller bearings 26. Said roller bearings 26 each include an inner race 36 which is snugly receivable over longitudinally central portions of axle 26 and an outer race 38 which is tightly receivable within a corresponding inner shoulder 40 or rotor 20. Each end portion 42 of axle 24, as best shown in FIG. 5, extends longitudinally beyond its respective end of rotor 20. A portion of the circumference of each end 42 is removed to form a flat surface 43 which is aligned in coplanar relationship with the flat surface of the opposite end 42. Flat surfaces 43 bear against mounting surface provided on implements and earth moving equipment, as described below, thereby preventing axle 24 from rotating about its longitudinal axis. Furthermore each end portion 42 is provided with an O-ring seal 45, which seal is received in a correspondingly shaped groove extending around the circumference of each end portion 42. Seal 45 is preferably constructed from neoprene material and serves to prevent dirt and other foreign matter from traveling inwardly along the length of axle 24 to contaminate bearings 26 and also serves to prevent leakage of lubricating fluid from cavity 34 to thereby eliminate the need for subsequently lubricating bearings 26 once said cavity 34 has been initially filled with a suitable lubricant.

A circular shaped longitudinal bore 44 extends inwardly from one end of axle 24 to approximately the center of said axle to intersect a circular shaped cross bore 46 which extends radially inwardly from the outer surface of axle 24 until it joins longitudinal bore 44. Longitudinal bore 44 and cross bore 46 cooperate to provide a passageway through which grease, oil or other type of lubricant can be introduced into cavity 34 to lubricate bearings 26. Because both bores 44 and 46 are of a diameter considerably smaller than a diameter of axle 24, the strength of said axle is not compromised by said two bores. A counterbore 48, which is concentric with longitudinal bore 44, is provided in axle end portion 42 and is threaded to receive hex plug 50 to close off the end of longitudinal bore 44.

The grease or oil contained within cavity 34 of rotor 20 not only serves as a lubricant for bearings 26, but also functions as a heat transfer and storage medium which absorbs heat frictionally generated by cutter teeth 32 as they penetrate into and exit from hard ground material during operation of roller cutter 18. The heat from cutter teeth 32 travels inwardly through rotor 20 and into the lubricating fluid within cavity 34. When roller cutter 18, which is mounted on the periphery of a large excavating bucket as described below, rises above the ground level, the rotor 20 continues to spin about axle 24, thereby cooling teeth 32 by transferring the heat within said teeth to the adjacent air. As teeth 32 cool, the heat stored within the lubricating fluid is transmitted through rotor 20 and then to teeth 32 thus reversing the direction of heat flow within roller cutter 18.

Each end of axle 24 is provided with identical end caps 28, which end caps not only serve to mount roller cutter 18 on various implements and earth moving equipment, but also serve to restrain and axially preload bearings 26. Each end cap 28 includes a central annular section 52 aligned concentrically with and closely and slidably receivable over axle 24. The inwardly directed free end portion 54 of annular section 52, as best seen in FIG. 5, abuts against bearing inner race 36 to provide the necessary axial pre-load to permit bearings 26 to function properly.

End cap 28 also includes a cap or cup section 56 which extends radially outwardly from annular section 52 at a longitudinal location corresponding to each end 58 of rotor 20 and then extends longitudinally inwardly to form a circular lip 60, which lip is both concentric with and closely receivable within outer shoulder 62 of rotor 20. Thus, it can be seen that cup section 56 precludes all but the smallest ground particles from entering into rotor cavity 34. Furthermore, the interior surface of lip 60 serves as a shoulder or counterbore 64 for housing the stationary member or half 66 of seal 30. The complementary rotating member or half 68 of seal 30 is housed within a corresponding intermediate counterbore 70 provided in each end portion of rotor 20. Together the adjacent faces 72 and 74 of seal halves 66 and 68, respectively, form a rotating seal or barrier to prevent not only the material being excavated, but also moisture from reaching the bearings 26.

Each end cap 28 also includes a lug section 76 which extends longitudinally outwardly from each cup section 56 and terminates at the end of axle 24. As best shown in FIGS. 4–6 and 10, said lug section 76 is generally in the shape of a rectangular block which has a width considerably greater than the width of its corresponding axle end portion 42. As most clearly shown in FIG. 6, each lug 76 includes a downwardly open slot 78 extending the entire length of lug 76 and shaped to partially encircle and closely receive a corresponding axle end portion 42. The lower surface 80 of each lug 76 is coplanar with the flat surface 43 of axle end portion 42 to provide a suitable surface for mounting roller cutter 18 onto different types of earth moving equipment.

A fastener, such as socket head cap screw 82, is provided to extend upwardly through a counterbored clearance hole located in each axle end portion 42 to engage into an aligned, threaded through hole provided in each lug section 76 to securely affix each end cap 28 to a corresponding axle end portion 42. Also, each lug section 76 is provided with a pair of vertical, counterbored holes through holes 84 transversely spaced on opposite sides of axle 24 for receiving various types of threaded fasteners, such as socket head cap screws 86. Said cap screw 86 engages into threaded openings provided in earth moving equipment to mount roller cutter 18 on said equipment.

Now referring specifically to FIGS. 1, 4–7, and 10, a series of teeth 32 are shown extending radially outwardly from the outer surface of rotor 20 to thus penetrate into ground material to fracture and loosen such material. Each tooth 32, as best shown in FIG. 5, is integrally formed with rotor 20 and, in profile, has a height H which is much longer than its maximum width. Also, each tooth 32 includes a radially converging, truncated, circular cone-shaped base portion 88 extending outwardly from the outer surface of rotor 20 and having a maximum diameter A. Each tooth 32 also includes a radially diverging, truncated, circular cone-shaped intermediate portion 90 having a minimum diameter B and a maximum diameter C; and also a radially converging circular cone-shaped tip portion 92 tapering downwardly from a maximum diameter C to an outward point. The diameter C of tooth 32, at the intersection of intermediate portion 90 and tip portion 92 is less than the maximum diameter A of base portion 88 but greater than minimum diameter B of base portion 88. Applicant has found that constructing teeth 32 with this particular profile permits hard ground material, such as permafrost, which has been fractured by tip portion 92 to expand into the recess formed by base portion 88 and intermediate portion 90.

To complement the spacing between teeth 32, as described below, and the particular size or rotor 20, also described below, preferably the maximum diameter A of tooth base portion 88 is 1.5 inches. Also, ideally the minimum diameter B of intermediate portion 90 is 0.75 inches and the maximum diameter C of intermediate portion 90 is 1 inch. With the portions of teeth 32 constructed with these diameters, applicant has found that for optimum design, the height D of base portion 88 should ideally be approximately 1 inch, the height E of intermediate portion 90 should be approximately 0.50 inch, and the height F of tip portion 92 should be approximately 1 inch for an overall height H of 2.5 inches. Constructing the portions of teeth 32 with these heights and diameters results in teeth which are not only long enough to penetrate relatively deeply into permafrost, but also strong enough to withstand the compression, bending and shear loads imposed on them as they enter and exit the ground.

Moreover, applicant has discovered that by forming the base portions 88, intermediate portions 90 and tip portions 92 of teeth 32 with a circular cross section, said teeth are capable of withstanding the bending loads imposed on them as they enter and exit the ground. It has been applicant's experience that teeth constructed in other cross sectional shapes, such as in a diamond, square or rectangle, are more likely to fail in bending than if formed with a circular cross section.

Figure 7:
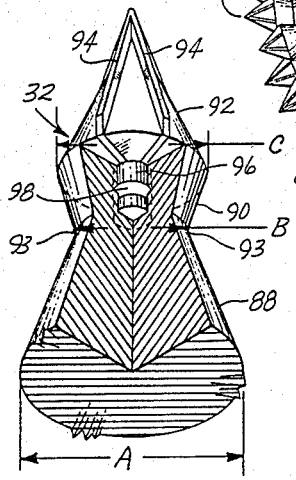
FIG. 7 is an enlarged isometric view of a single cutter tooth shown with portions broken away.
Figure 8:
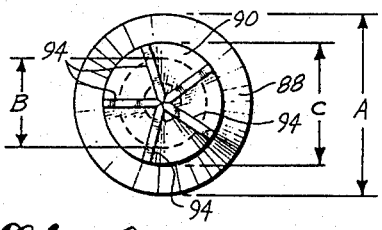
FIG. 8 is a top view of the cutter tooth shown in FIG. 7.

Each tooth 32, as most clearly shown in FIGS. 7 and 8, includes integral cutter blade 94 extending outwardly from and disposed lengthwise along substantially the entire length of, and spaced around the circumference of each tooth tip 92 such that the outer edges of said cutter blades 94 define a cone corresponding to the shape of tip portion 92. Each cutter blade 94 extends radially inwardly from the outer surface of tip portion 92 to intersect a centrally disposed, longitudinal stem 96, which stem is of generally circular cross section. Furthermore, portions of said stem 96 extend lengthwise of said cutter blades 94 to extend into tooth intermediate portion 90 to help anchor said cutter blades within tooth 32. This longitudinally extending portion of stem 96 includes a groove 98 which extends around the circumference of said stem. Since stem 98 is completely filled by the surrounding portions of the tooth intermediate portion 90, said groove further locks cutter blades 94 within tooth 32.

Preferably rotor 20 and teeth 32 are cast together in a single mold after cutter blades 94 have been previously placed within the mold so that the molten material (e.g. steel) from which teeth 32 are formed can completely encircle stem 96 to support cutter blades 94. To prolong their useful life, cutter blades 94 are ideally constructed from material, such as tungsten carbide, which is much harder than the material from which teeth 32 and rotor 20 are cast. Furthermore, constructing cutter blades integrally with teeth 32 and disposing said cutter blades along the length of tip portion 92, permits said blades both to be positioned a substantial distance outwardly of rotor 20 and to extend for a considerable distance radially of rotor 20 to thereby penetrate deeply into the ground material being fractured. Since conventional cutter teeth are usually made entirely from hard materials, such as from tungsten carbide, the brittleness of such teeth causes them to fracture and break if they extend very far above the height of the drum on which they are mounted.

Figure 4:
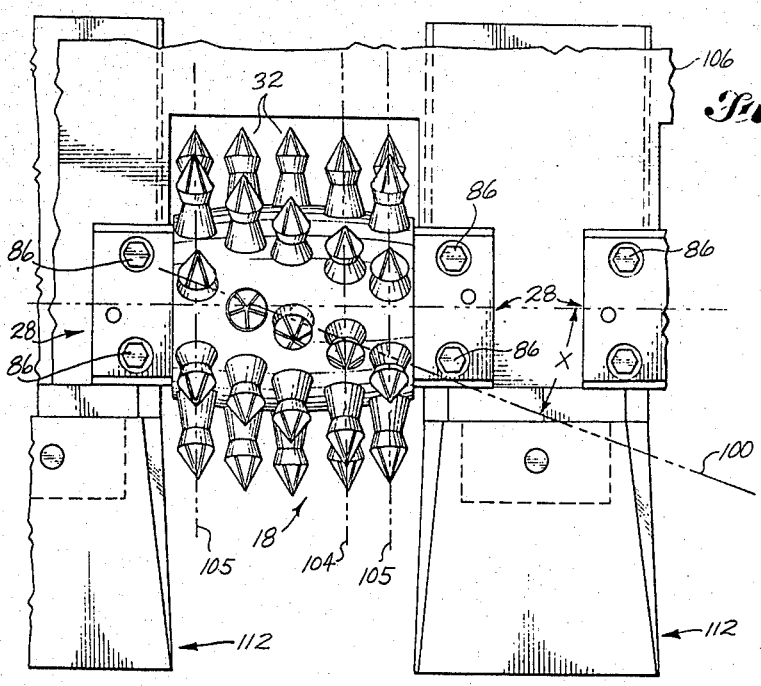
FIG. 4 is a top view of the typical roller cutter and scoop tooth shown in FIG. 1.
Figure 10:
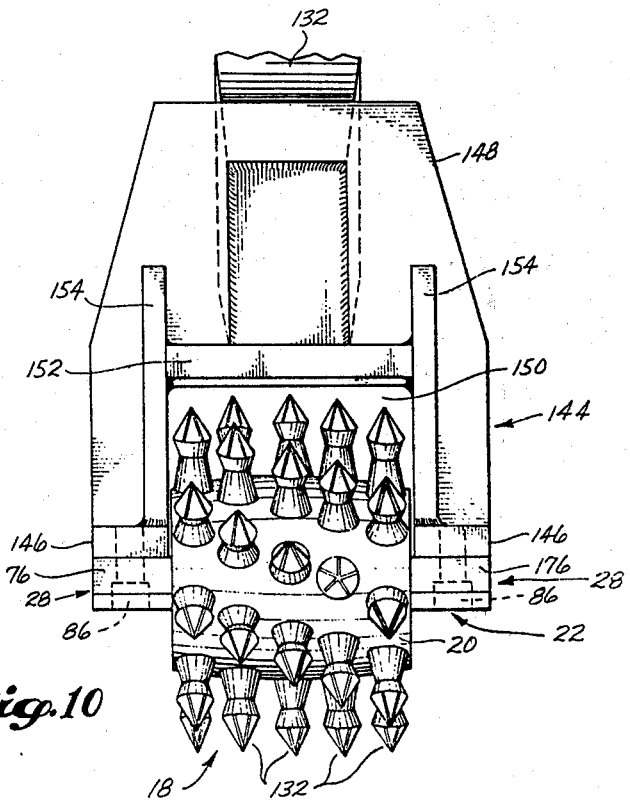
FIG. 10 is a front elevational view of the roller cutter shown in FIG. 9 as viewed substantially along lines 10—10 thereof.

As most clearly illustrated in FIGS. 1, 4 and 10, teeth 32 are not arranged in straight rows along the length of rotor 20, but rather they are evenly spaced along the length of nine separate helical rows 100 with five teeth 32 in each row. Each of the rows 100 is disposed at an angle X from the longitudinal centerline 102 of rotor 20, and the rows 10 are equally angularly spaced about the circumference or rotor 20. By positioning teeth 32 about rotor 20 in this manner, except for the teeth 32 located at opposite ends of adjacent helical rows 100, each of the teeth 32 is individually equally angularly spaced apart from the adjacent teeth about the circumference of rotor 20. Consequently, only one of these angularly spaced teeth reaches full penetration into the ground at a time; thus, only one tooth at a time is fully loaded by rotor 20. As a result, less force need be applied to roller cutter 18 to enable it to efficiently and successfully fracture hard ground material than is required by cutters of other designs.

As best shown in FIGS. 4 and 6, the particular helix angle of each row 100 results in the tooth 32 at each end of every row 100 being longitudinally aligned with a tooth 32 at the opposite end of an adjacent row 100 so that such two teeth enter and exit the ground together while all of the remaining teeth enter the ground one at a time. As a result, the ends of rotor 20 and axle 22 are not subjected to an extreme, unbalanced load when the teeth 32 penetrate the ground. Consequently, the axle 24 and bearings 26 are less likely to fail under load than if the teeth 32 at the opposite ends of adjacent helical rows 100 were not longitudinally aligned with each other.

The arrangement of teeth 32 about rotor 20 can be otherwise described by stating that the teeth are arranged about the circumference of rotor 20 in a series of circular intermediate rings 104 and a pair of end rings 105, which rings are each equally spaced apart along the length of rotor 20. The teeth 32 of each of the individual rings 104 and 105 are evenly spaced about the circumference of the ring with an angle Z separating angularly adjacent teeth 32 of each ring, FIG. 6. However, the corresponding teeth of adjacent rings are not longitudinally aligned along the length of rotor 20, but rather the rings 104 are progressively rotated relative to each other so that each tooth 32 of each ring 104 is slightly staggered at an angle Y with respect to a corresponding tooth of an adjacent ring. The angle of relative rotation between adjacent rings 104 is such that the total angle separating the teeth 32 at opposite ends of each row is equal to the angle Z separating the adjacent teeth 32 of each ring. As a consequence, the teeth 32 of the rings 104 at each end of rotor 20 are aligned with each other. However, with the exception of the alignment of the teeth of the rings 105 at each end of rotor 20, the teeth 32 are each uniformly angularly spaced apart from each other about the circumference of rotor 20.

Preferably, roller cutter 18 is constructed with five rings 104 and nine teeth 32 spaced about each of said rings 104 for a total of 45 individual teeth. Since the nine teeth of the ring 104 at one end of rotor 20 are aligned with nine corresponding teeth of the ring 104 at the opposite end of rotor 20, the remainder of the teeth 32 are located about the circumference of rotor 20 at thirty-six individual locations and thus are spaced apart an angle Y of 10° from each other about the circumference or rotor 20. Also, since each ring 104, 105 preferably includes nine teeth 32, the angle Z separating angularly adjacent teeth 32 in each ring 104, 105 is equal to 40°.

With the exception of the teeth of the rings 105 located at each end of rotor 20, the individual spacing of teeth 32 about the circumference of said roller permits them to individually progressively enter and then exit the ground being excavated. Thus, other than the teeth 32 composing the end rings 105, only one tooth 32 at a time is aligned with the force imparted on rotor 20 by stator 22 as said cutter teeth penetrate the ground material. Correspondingly, only one tooth 32 at a time is aligned with the reaction force imparted on the rotor by the ground material being penetrated. As a consequence, the amount of energy needed to efficiently operate roller cutter 18 is less than would be required if a larger number of teeth 32 were radially aligned to simultaneously enter and exit the ground. Therefore, it can be appreciated that staggering the teeth 32 about the circumference of rotor 20, in the particular manner described above, results in an efficient roller cutter 18 which can be successfully utilized on less powerful earth moving equipment than is required by conventional roller cutters.

Since the teeth 32 composing the end rings 105 are aligned with each other, they enter and exit the ground together so as not to subject the ends of rotor 20 and axle 22 to an extreme unbalanced load. Furthermore, since only the teeth 32 of the two end rings 105 are aligned with each other, the correspondingly aligned teeth of the end rings 105 enter the ground sequentially with the teeth composing the intermediate rings 104. Consequently, the teeth of the end rings do not penetrate the ground at the same time as the teeth of the intermediate rings.

In addition to locating teeth 32 about rings 104, 105 so that the teeth progressively enter and exit the ground, preferably the rings 104, 105 are spaced apart along the length of rotor 20 with approximately 1.63 inches separating adjacent rings 104, 105. Moreover, ideally rotor 20 is slightly barrel-shaped with a length of 8.0 inches, a minimum outside diameter of 6.0 inches and a maximum outside diameter of 6.5 inches. By constructing rotor 20 with these dimensions and spacing rings 104, 105 apart in the manner described above, teeth 32 are substantially uniformly distributed about the entire outer circumferential area of rotor 20 with one tooth 32 per approximately 3.5 square inches of rotor surface area. Applicant has discovered that by providing this amount of rotor surface area per tooth and by constructing teeth 32 with the dimensions described above, results in an optimum design which is capable of efficiently fracturing permafrost material.

Applicant has also found that if too few teeth 32 are used or if they are improperly spaced so that too large of a space exists between the teeth, the leading teeth of the rotor 20 will not anchor into the ground to help drive the following teeth. As a result, the teeth 32 will tend to slip or wipe relative to the ground. This wiping action causes very rapid wear of the tooth tip portions, thus drastically decreasing the life of the teeth. Correspondingly, the expense of excavating a given volume of ground material is markedly increased.

If, on the other hand, too many rings of teeth are used, or too many teeth are placed in each ring or the teeth that are utilized are spaced too closely together, then not enough distance will exist between angularly adjacent teeth to permit hard ground material, such as permafrost, to crack and thereby fall away from the teeth as they enter the ground. Rather, the teeth will merely tend to compress the ground material instead of efficiently fracturing it. Furthermore, if too many teeth are used or if the teeth are located too closely together, several teeth may enter the ground together, or nearly simultaneously together, thereby reducing the penetrating force per tooth so that they may not be able to engage to full depth into the ground. As a result, the efficiency of roller cutter 18 is significantly diminished. Also, the power requirement necessary to force the teeth into the ground increases in direct proportion to the number of teeth entering the ground at any given time. In general, it has been determined that there should be approximately 3–5 square inches of rotor surface are per tooth, and preferably about 3.5 square inches surface area per tooth for optimal penetration and fracture of permafrost.

However, constructing roller cutter 18 in the manner described above so that teeth 32 enter the ground one at a time and also so that they are optimumly spaced apart from each other enables the teeth to readily penetrate and fracture hard ground material. Thus, it can be appreciated that if for a particular application a larger diameter roller cutter is desired, to maintain the efficiency of the cutter, the number of teeth 32 per row is to be increased and also the spacing between adjacent rows is to be altered to maintain the above mentioned amount of rotor surface area per tooth 32. Furthermore, if a smaller diameter roller cutter is desired, the number of teeth 32 per row is to be decreased and also the spacing between adjacent rows is to be altered to ensure that the teeth 32 are uniformly distributed about the outer surface of the rotor and also to ensure that the desired ratio of rotor surface area per tooth 32 is maintained.

The above-described construction of roller cutter 18 permits it to be used on many different types of implements and earth moving equipment. For instance, roller cutters similar to cutter 18 may have been used on an endless bucket type of excavator as disclosed by my own U.S. Pat. No. 3,967,854, and as illustrated in FIGS. 1, 4 and 5. Endless bucket excavators are nominally used to dig trenches and are characterized by being constructed with a large diameter wheel which is supported for rotation about its transverse axis and for translation along the ground. A chain of forwardly open, arcuately shaped buckets is mounted on the periphery of the wheel with the width of the bucket defining the width of the trench to be dug. While digging a trench, the large wheel is partially below ground level, with the bottom of the wheel corresponding to the bottom of the trench. As the wheel rotates and moves forwardly, each bucket generally tangentially enters the ground at the bottom of the trench and, in effect, planes off a layer of ground material and then exits the ground as it rises above the general ground level.

Roller cutters 18 are spaced apart along the length of an arcuate mounting plate 106 which is fixedly mounted along the lip of each bucket to form the transverse leading edge portion of the bucket. Thus, rotor 20 of each roller cutter 18 is disposed transversely of the translational direction of travel of the excavator wheel. As each bucket enters the ground, rotor 20 rotates about its longitudinal axis so that its teeth 32 progressively enter and exit the ground to thus loosen said ground material so that it can be scooped up by a trailing bucket.

Applicant has found that mounting roller cutters 18 on mounting plates 106 so that the helical rows 100 of teeth 32 rotate in one direction on one bucket and in the opposite direction of the bucket located next behind, the large diameter wheel about which the chain of buckets is mounted tends to make the wheel travel in a straight line rather than tending to turn to one side or the other as would occur if the roller cutters 18 of all the buckets were constructed with helical rows 100 which all extended in the same direction.

Figure 3:
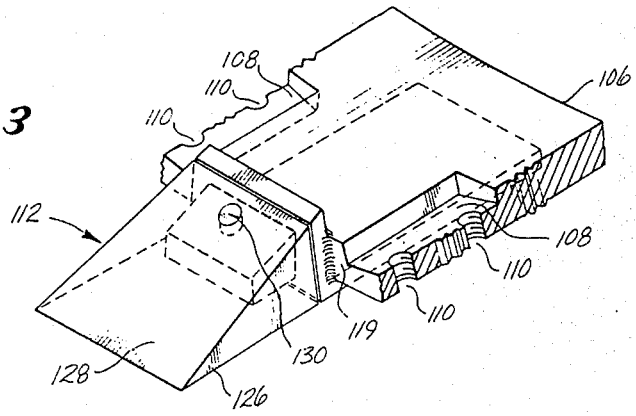
FIG. 3 is a fragmentary isometric view of the scoop tooth shown in FIGS. 1 and 2.

Because mounting plate 16 has been formed to match the arcuate shape of the excavator buckets, said mounting plate is provided with lands or relieved portions 108 to permit end caps 28 to rest on a flat surface, FIG. 3. Lands 108 include through holes 110 for receiving capscrews 86 to thereby mount the roller cutter 18 onto mounting plate 106.

Figure 2:
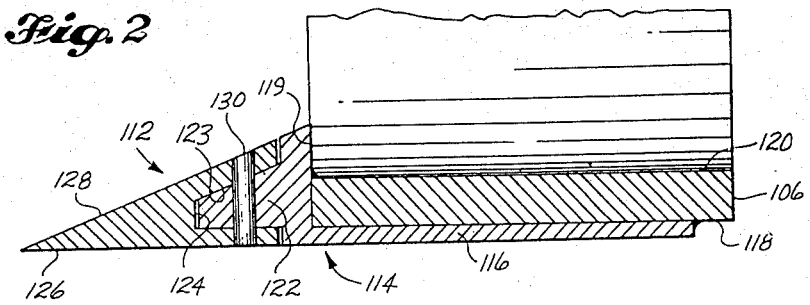
FIG. 2 is an enlarged cross-sectional view of the scoop tooth illustrated in FIG. 1 taken substantially along line 2—2 thereof.

As most clearly shown in FIG. 1, scoop teeth 112 are disposed between adjacent roller cutters 18. Referring additionally to FIGS. 2 and 3, said scoop teeth 112 each include a shoe 114 which is fixedly attached to mounting plate 106, preferably by welding. Shoe 114 includes a base portion 116 which overlaps the bottom surface 118 of mounting plate 106 and extends upwardly along the front or leading edge 119 to an elevation above the upper surface 120 of said mounting plate 106. Shoe 114 also includes an integral, generally rectangularly shaped plug portion 122 which extends outwardly forwardly from base portion 116. The upper surface 123 of said plug portion 122 is downwardly and forwardly tapered to match the corresponding shape of socket 124 provided in the rear end or heel portion of bit 126. As can be seen in FIG. 2, plug 122 fits closely within socket 124 to ensure that bit 126 is tightly held by shoe 114. The top surface 128 of bit 126 extends forwardly and downwardly so that in side elevation said bit 126 assumes a forwardly tapered shape to enable scoop tooth 112 to efficiently penetrate and lift ground material. Aligned through holes are provided in the heel portion of bit 126 and in plug 122 to receive a fastener, such as pin 130, to ensure that said bit 126 remains engaged with shoe 114.

It can be appreciated that by constructing each scoop tooth 112 with a removable bit 126, said bit can be easily and economically replaced when it is worn out through use. Furthermore, the construction of scoop tooth 112 enables bit 126 to be formed from harder material than base 116. Alternatively, bit 126 can be either heat treated or otherwise hardened to minimize its tendency to wear as it is drawn through ground material. Correspondingly, because only shoe 114 is required to actually fracture hard ground material, said shoe can be formed from material which is relatively softer than the material used to form bit 126 thus reducing the cost of manufacturing said shoe and also permitting it to be readily welded on to mounting plate 106.

Figure 9:
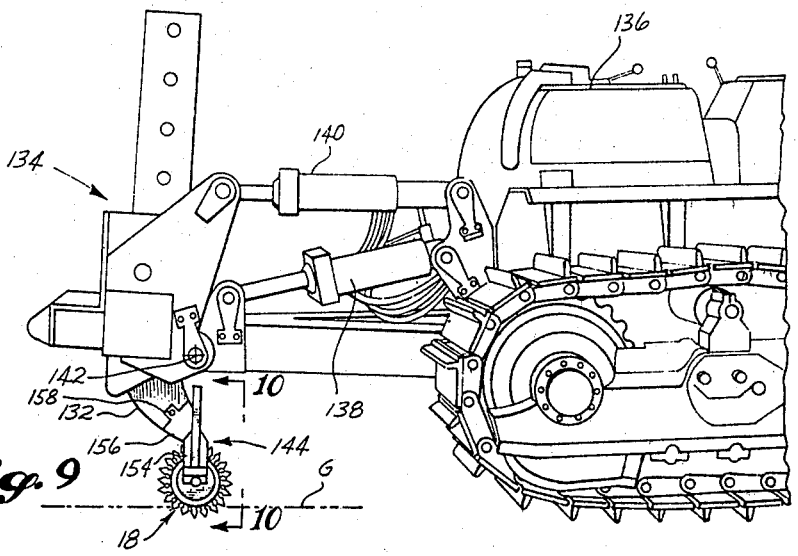
FIG. 9 is a reduced scale pictorial view of a typical roller cutter of the present invention shown attached to a ripper bar.

An alternative manner of utilizing roller cutter 18 is illustrated in FIGS. 9 and 10. Said roller cutter 18 is shown attached to the lower end of a ripper bar 132 which is supported by ripping implement 134. Ripping implement 134 is pivotally mounted on crawler tractor 136. Lifting cylinder 138 is provided to raise the rear end of implement 134 and tilting cylinder 140 is provided to pivot ripping implement 134 about transverse axis 142. Thus in use, ripping implement 134 can be lowered to cause roller cutter 18 to penetrate into the ground G to efficiently fracture and loosen said ground. At the end of a run, or when otherwise desired, roller cutter 18 can be lifted upwardly away from ground G by simply retracting lifting cylinder 138.

Now referring to FIG. 10, roller cutter 18 is shown bolted to bracket weldment 144 through the use of cap screws 86 which extend upwardly through through holes 84 provided in end cap lug sections 76 and engage into aligned threaded holes provided in horizontally disposed base plates 146 located on each side of the bottom portion of bracket weldment 144. Said bracket weldment 144 also includes a transversely disposed, vertical hanger plate 1 48, which hanger plate is downwardly forked or bifurcated to produce a central opening or slot 150 to provide clearance for rotor 20 and teeth 32. Bracket weldment 144 also includes a pair of horizontal reinforcing bars 152, one each of which is located on each face of hanger plate 148 at an elevation slightly above opening 150. A vertical reinforcing bar 154 is located adjacent each vertical edge of opening 150 such that the bottom of each vertical reinforcing bar 154 rests on its corresponding base plate 146 and also laterally abuts against the adjacent end of horizontal reinforcing bar 152. Thus, it can be appreciated that bracket weldment 144 is constructed ruggedly enough to withstand the loads imparted on roller cutter 18 as said roller cutter penetrates ground G.

Conventional ripper bars generally extend arcuately downwrdly and forwardly to serve as a mount for a removable tip 156, which tip in use is dragged through the ground by crawler tractor 136. Tip 156 is attached to the ripper bars through the use of pin 158. The construction of bracket weldment 144 permits existing ripper bars to be altered by cutting off the leading point of the tip and replacing it with said bracket 144 which can be conveniently welded to the removable tip. Furthermore, because roller cutter 18 is capable of efficiently loosening hard ground material, it is contemplated that several roller cutters 18 can be attached to implements such as ripping implement 134 thereby sweeping a wider path with each pass of crawler tractor 136 than is possible when using conventional ripper bars. Moreover, roller cutters 18 can be provided in varying diameters, depending on the depth to which it is desired to fracture and loosen ground G.

What is claimed is:

1. In a roller cutter adapted to be mounted on earth moving equipment to penetrate hard ground material for fracturing and loosening such ground material including an annular roller adapted to rotate about its longitudinal axis, a stator, and antifriction bearings mounted on the stator for supporting the roller for rotation about its longitudinal axis, the improvement comprising a plurality of substantially identical cutter teeth integrally formed with the rotor, said cutter teeth each extending radially outwardly from the outer surface of the rotor a distance substantially greater than the width of said teeth, and each being arranged in a plurality of rings about the circumference of the rotor to form a first end ring adjacent one end portion of the rotor, a plurality of intermediate rings and a second end ring adjacent the opposite end portion of the rotor, with the teeth of each of said rings being progressively staggered with respect to the corresponding teeth of the adjacent rings so that said teeth are each uniformly angularly spaced apart about the circumference of the rotor and the tip-to-tip spacing between the teeth in each of the plurality of rings being substantially uniform throughout so that, considering the uniformly spaced apart teeth forming said intermediate rings, only one such tooth is aligned at any one time with the force imparted on the rotor by the stator as said uniformly spaced teeth successively penetrate the ground, and so that considering the teeth forming said end rings, only two longitudinally opposed such teeth are aligned with the force imparted by the rotor on the stator at any one time and at a time other than the time of such force alignment on any tooth of any intermediate ring.

2. The improvement according to claim 1, wherein said teeth are substantially uniformly spaced about the outer surface of the rotor with one tooth per approximately 3 to 5 square inches of rotor surface area.

3. The improvement according to claims 1 or 2, wherein:

the rotor is slightly barrel shape with a length of approximately 8.0 inches, a minimum diameter of approximately 6.0 inches and a maximum diameter of approximately 6.5 inches;

each of said teeth being of identical size and shape having a maximum diameter of approximately 1.5 inches; and, each of said rings having nine teeth and said rotor having five rings.

4. The improvement according to claim 1, wherein each of said cutter teeth includes:

an outwardly converging, circular frustoconical base portion extending radially outwardly from said rotor;

an outwardly diverging, circular frustoconical intermediate portion, and an outwardly converging, circular conical tip portion.

5. The improvement according to claim 4, further comprising a plurality of elongate cutter blades extending radially outwardly from the outer surface of the tip portion of each tooth, said cutter blades extending along the entire length of the tip portion and spaced about the circumference of the tip portion, with the outer edges of said cutter blades defining a cone corresponding to the shape of the tip portion; and wherein each of said cutter blades is centrally interconnected about a longitudinal central stem, said stem extending lengthwise of said cutter blades and into the tooth intermediate portion to anchor said blades in said tooth.

6. In a roller cutter mountable on earth moving machines to penetrate hard ground material for fracturing and loosening such ground material, the roller cutter including a circularly shaped rotor adapted to rotate about an axis perpendicular to the circumference of the rotor, and a stator for antifrictionally and rotatably supporting the roller on earth moving machines, the improvement comprising:

a plurality of cutter teeth integrally formed with the rotor and equally spaced apart along the length of a plurality of helical rows, each of said helical rows being disposed along the length of said rotor in uniform helix angles and said helical rows being equally spaced apart about the circumference of the rotor so that the tooth located at each end of each helical row is longitudinally aligned along the length of the rotor with a tooth at the opposite end of a next adjacent helical row, and with the exception of the teeth located at opposite ends of adjacent helical rows being aligned with each other, each of said teeth being spaced a uniform angular distance apart from each other about the circumference of the rotor; and each of said teeth including an outwardly converging, frustoconical base portion extending radially outwardly from the outer circumference of said rotor, an outwardly diverging, frustoconical intermediate portion extending outwardly from said base portion and an outwardly converging, conical tip portion extending outwardly from said intermediate portion.

7. The improvement according to claim 6, wherein the base, intermediate and tip portions of each of said teeth are circular in cross section with the maximum diameter of said teeth being approximately 1.5 inches; and said teeth are substantially uniformly distributed about the surface area of the rotor with one tooth per approximately 3.5 square inches of rotor surface area.

8. The improvement according to claim 7, wherein the roller cutter includes five helical rows of said teeth and each helical row includes nine teeth, and the rotor is formed in a slightly barrel shape having a length of approximately 8.0 inches, a maximum outside diameter of approximately 6.5 inches and a minimum outside diameter of approximately 6 inches.

9. The improvement according to claim 6, further comprising a plurality of elongate, cutter blades extending radially outwardly from the outer surface of the tip portion of each of said teeth, said blades being disposed longitudinally along substantially the entire length of, and spaced about the circumference of the tip portion, with the outer edges of said cutter blades defining a cone corresponding to the conical shape of the tip portion, wherein said cutter blades are centrally interconnected about a longitudinal central stem, said stem extending lengthwise of said cutter blades and into the tooth intermediate portion to anchor said blades into said tooth.

10. A multiple cutter unit carried by earth moving equipment for penetrating hard ground material to fracture and loosen such material, the cutter unit including a mounting plate disposed transversely of the line of travel of the earth moving equipment, a plurality of scoop teeth spaced along and extending forwardly of the mounting plates, and a plurality of roller cutters mounted on, spaced along, and extending forwardly of the mounting plate, each of the roller cutters including an annularly shaped rotor disposed transversely of the length of travel of the earth moving equipment, and a stator for antifrictionally supporting the rotor for rotation about its longitudinal axis, the improvement comprising a plurality of cutter teeth integrally formed with and extending radially outwardly from the outer surface of the rotor, said cutter teeth being arranged along the length of the rotor in a plurality of helical rows with:

the cutter teeth of each helical row being evenly spaced apart along the length of each helical row to define a first cutter tooth disposed adjacent one end portion of the rotor, a last cutter tooth disposed adjacent the opposite end portion of the rotor, and a plurality of intermediate cutter teeth disposed between said first and last cutter teeth of each helical row; and the helical rows being disposed along a uniform helix angle relative to the longitudinal axis of a rotor such that the first tooth of each helical row is longitudinally aligned along the rotor with the last tooth of an adjacent helical row, and with the last tooth of each helical row being longitudinally aligned along the rotor with the first tooth of the other adjacent helical row so that other than the alignment of the first and last tooth of each helical row with a last and first tooth, respectively, of adjacent helical rows, each of said teeth of the rotor being equally angularly spaced about the circumference of the rotor and the tip-to-tip spacing between the teeth in each of the plurality of rings being substantially uniform throughout to uniformly and sequentially penetrate into the ground one at a time and at a time other than the time at which the teeth at opposite ends of adjacent helical rows penetrate into the ground.

* * * * *